US011409224B2

(12) United States Patent
Ogawa et al.

(10) Patent No.: US 11,409,224 B2
(45) Date of Patent: Aug. 9, 2022

(54) IMAGE FORMING APPARATUS IN WHICH SCANNER FRAME AND SUPPORT FRAME ARE CONNECTED AND FIXED

(71) Applicant: KYOCERA Document Solutions Inc., Osaka (JP)

(72) Inventors: Naozumi Ogawa, Osaka (JP); Hiroyoshi Omura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/487,431

(22) Filed: Sep. 28, 2021

(65) Prior Publication Data

US 2022/0100143 A1 Mar. 31, 2022

(30) Foreign Application Priority Data

Sep. 30, 2020 (JP) ..... JP2020-165382

(51) Int. Cl.
*G03G 21/16* (2006.01)

(52) U.S. Cl.
CPC ..... *G03G 21/1619* (2013.01)

(58) Field of Classification Search
CPC ..... G03G 21/1619
See application file for complete search history.

(56) References Cited

U.S. PATENT DOCUMENTS

2013/0287432 A1* 10/2013 Ikeda ..... G03G 21/1619 399/107
2017/0017195 A1* 1/2017 Kiuchi ..... G03G 21/1619

FOREIGN PATENT DOCUMENTS

JP 2003-078256 A 3/2003

* cited by examiner

*Primary Examiner* — Sandra Brase
(74) *Attorney, Agent, or Firm* — IP Business Solutions, LLC

(57) ABSTRACT

An image forming apparatus includes a housing frame, a scanner frame, a first support frame, a second support frame, and a connecting member. The second support frame supports the scanner frame. The second support frame includes a horizontal support member and a vertical support member. The scanner frame includes a member to be connected. The insertion plate of the connecting member penetrates through the opening of the member to be connected in the first direction, and is inserted through the opening of the vertical support member. The insertion plate has an upper face located in contact with an upper end face of the opening of the member to be connected, at least via one position, and has a lower face located in contact with a lower end face of the opening of the vertical support member, at least via two positions spaced from each other in the second direction.

6 Claims, 10 Drawing Sheets

IMAGE FORMING APPARATUS IN WHICH SCANNER FRAME AND SUPPORT FRAME ARE CONNECTED AND FIXED

INCORPORATION BY REFERENCE

This application claims priority to Japanese Patent Application No. 2020-165382 filed on Sep. 30, 2020, the entire contents of which are incorporated by reference herein.

BACKGROUND

The present disclosure relates to an image forming apparatus.

Many of existing image forming apparatuses include a main frame of the apparatus, and a scanner frame mounted on the upper side of the main frame, so as to provide a sheet delivery space between the main frame and the scanner frame.

The main frame includes a first support frame and a second support frame, for supporting the scanner frame. The first support frame is located adjacent to the sheet delivery space on the upstream side in the sheet delivery direction. The second support frame is located adjacent to the rear side of the sheet delivery space, in the front-back direction of the apparatus orthogonal to the sheet delivery direction. The scanner frame is supported by each of the first support frame and the second support frame, in a cantilever form. The sheet delivery space is open toward two directions where the support frame is not provided, namely the front side of the apparatus, and the downstream side in the sheet delivery direction.

With such a cantilever support structure, the portion of the scanner frame not supported by the support frame may sag downward, such that the scanner frame may become distorted as a whole.

As the remedy therefor, in general, a side plate frame is additionally provided on the main frame, on the downstream side in the sheet delivery direction, and the side plate frame and the scanner casing are connected via a fastening member. In this case, the respective end portions of the fastening member are fixed to the side plate frame and the scanner casing, with a bolt.

SUMMARY

The disclosure proposes further improvement of the foregoing techniques.

In an aspect, the disclosure provides an image forming apparatus including a housing frame, a scanner frame, a first support frame, a second support frame, and a connecting member. The housing frame accommodates an image forming device that forms an image on a sheet. The scanner frame is located on an upper side of the housing frame, so as to provide a sheet delivery space between the housing frame and the scanner frame. The first support frame accommodates a sheet delivery mechanism that discharges the sheet in a predetermined first direction, and supports the scanner frame, at a position adjacent to the sheet delivery space on one end portion in the first direction. The second support frame supports the scanner frame, at a position adjacent to the sheet delivery space on one end portion in a second direction orthogonal to the first direction. The connecting member connects and fixes the second support frame and the scanner frame together. The second support frame includes a horizontal support member and a vertical support member. The horizontal support member extends along the first direction, and supports the scanner frame via an upper face. The vertical support member extends in an up-down direction, and has an upper end portion fixed to an end face of the horizontal support member on a side of the other end portion in the first direction. The scanner frame includes a member to be connected. The member to be connected is located on the side of the other end portion in the first direction, and connected to the vertical support member from the side of the other end portion in the first direction. The vertical support member and the member to be connected each include an opening. The connecting member includes an insertion plate. The insertion plate penetrates through the opening of the member to be connected in the first direction, and is inserted through the opening of the vertical support member. The insertion plate has an upper face located in contact with an upper end face of the opening of the member to be connected, at least via one position, and has a lower face located in contact with a lower end face of the opening of the vertical support member, at least via two positions spaced from each other in the second direction.

DETAILED DESCRIPTION

Hereafter, some embodiments of the disclosure will be described in detail, with reference to the drawings. However, the disclosure is not limited to the following embodiments.

Embodiment 1

Figure 1:
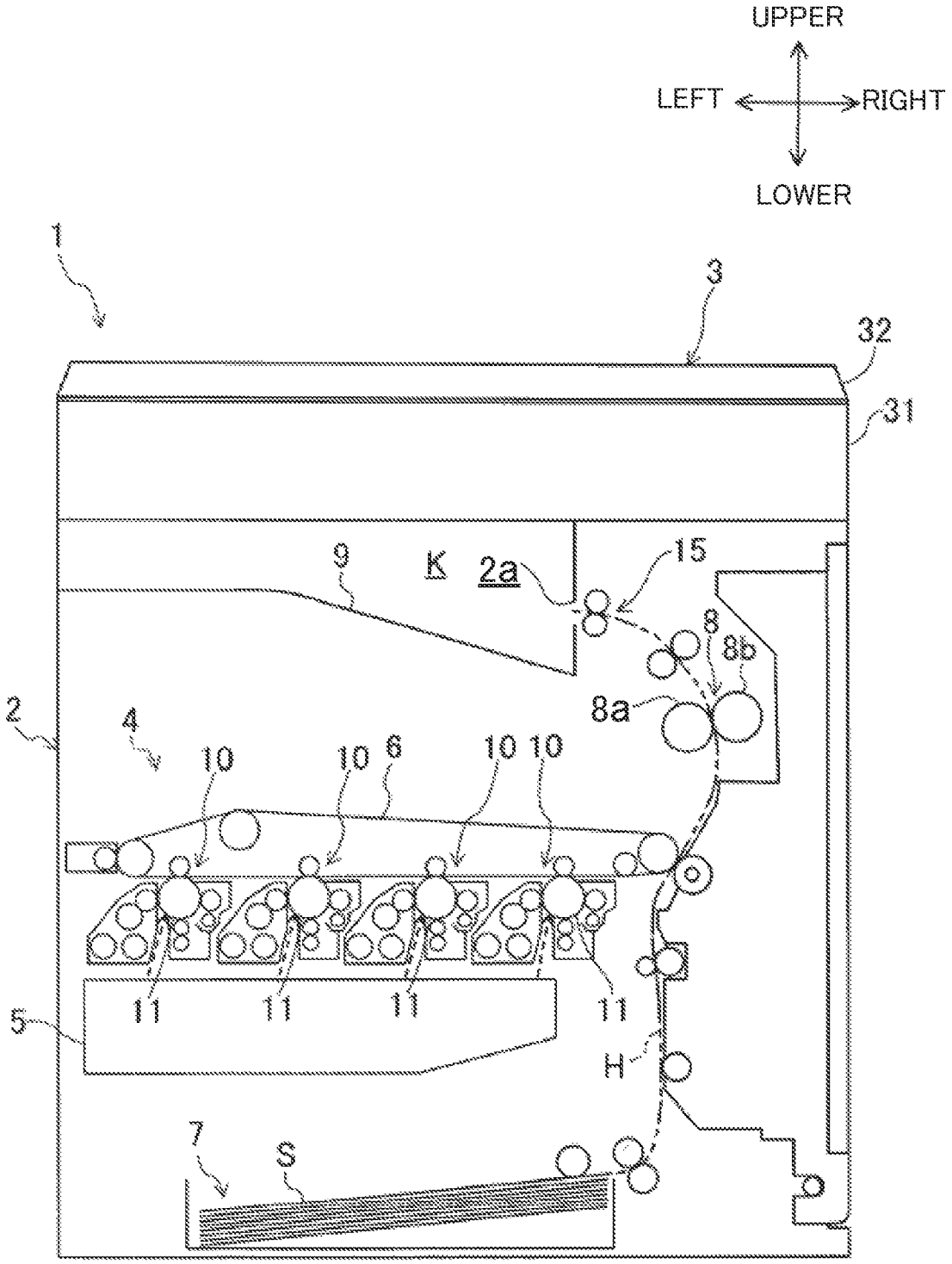
FIG. 1 is a schematic cross-sectional view showing a general configuration of an image forming apparatus.

FIG. 1 is a schematic cross-sectional view showing a general configuration of an image forming apparatus 1 according to an embodiment of the disclosure. In the following description, the terms such as "front side", "rear side", "left side", and "right side" each indicate, unless otherwise specifically noted, a direction defined by directional axes in FIG. 1, with respect to the image forming apparatus 1.

[General Configuration]

The image forming apparatus 1 is what is known as an in-body delivery type copier. The image forming apparatus 1 includes an apparatus main body 2, and an image reading device 3 located on the upper side of the apparatus main body 2.

The image reading device 3 includes a scanner casing 31, and a document retention member 32 that openably covers a contact glass provided on the upper face of the casing 31. The image reading device 3 optically reads the image of a source document placed on the contact glass, and generates image data.

The apparatus main body 2 includes, thereinside, an image forming device 4 that transfers and forms the image on a sheet S, on the basis of the image data of the source document read by the image reading device 3.

An exposure device 5 that emits a laser beam is provided on the lower side of the image forming device 4. On the upper side of the image forming device 4, a transfer belt 6 is provided.

A paper cassette 7, in which the sheets S are stored, is located under the exposure device 5. A fixing device 8 that fixes the image formed by transfer on the sheet S is located on the upper right side of the transfer belt 6. On the upper left side of the fixing device 8, a discharge roller pair 15 (exemplifying the sheet delivery mechanism in the disclosure) that discharges the sheet S to outside through a sheet delivery port 2*a*, in the left-right direction (exemplifying the first direction in the disclosure), is provided.

A sheet delivery space K is provided between the apparatus main body 2 and the image reading device 3. The space K is open toward two directions, namely the front side and the left side.

A sheet output tray 9, on which the sheets S discharged to the sheet delivery space K are to be stacked, is provided on the upper face of the apparatus main body 2. Inside the apparatus main body 2, a sheet transport route H is formed from the paper cassette 7 to the sheet output tray 9.

The image forming device 4 includes four image forming units 10, respectively corresponding to yellow, magenta, cyan, and black. The image forming units 10 each include a photoconductor drum 11. The image forming units 10 each develop an electrostatic latent image formed on the photoconductor drum 11 by the exposure device 5, with a developing device, thereby visualizing the image as a toner image of the corresponding color. The image forming device 4 sequentially transfers the toner images of the respective colors, formed on the photoconductor drum 11 of each of the image forming unit 10, on the intermediate transfer belt 6 so as to superpose the toner images, and then transfers the superposed images on the sheet S supplied from the paper cassette 7.

The fixing device 8 includes a heat roller 8*a* and a pressure roller 8*b*. The fixing device 8 heats and presses the toner image, carried by the sheet S delivered from the image forming device 4, thereby thermally fixes the toner image on the sheet S. The sheet S that has undergone the fixing process is delivered to the sheet output tray 9.

[Frame Structure of Image Forming Apparatus]

Figure 2:
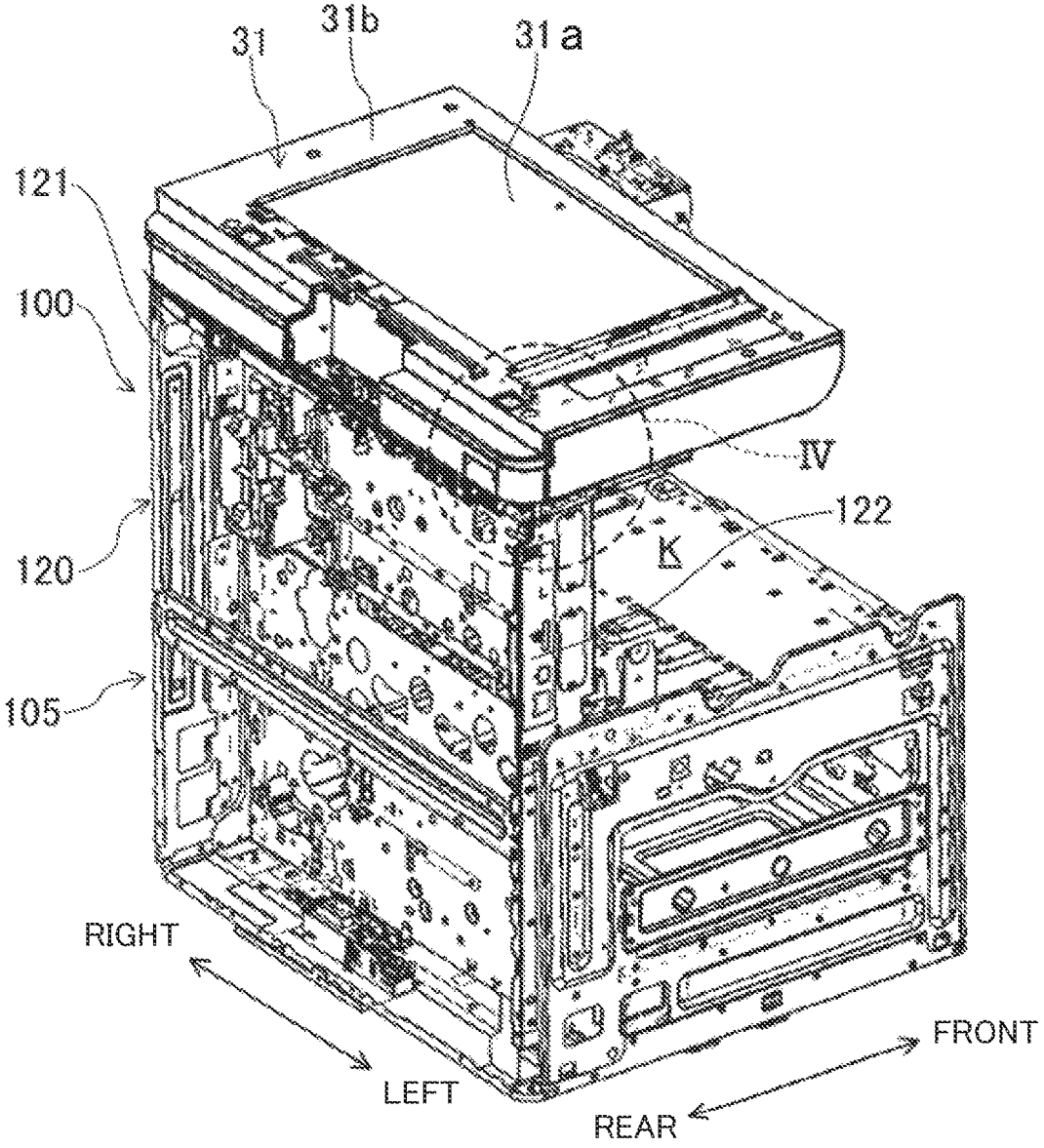
FIG. 2 is a perspective view showing an apparatus main body, from which an outer cover has been removed to expose a main frame.
Figure 3:
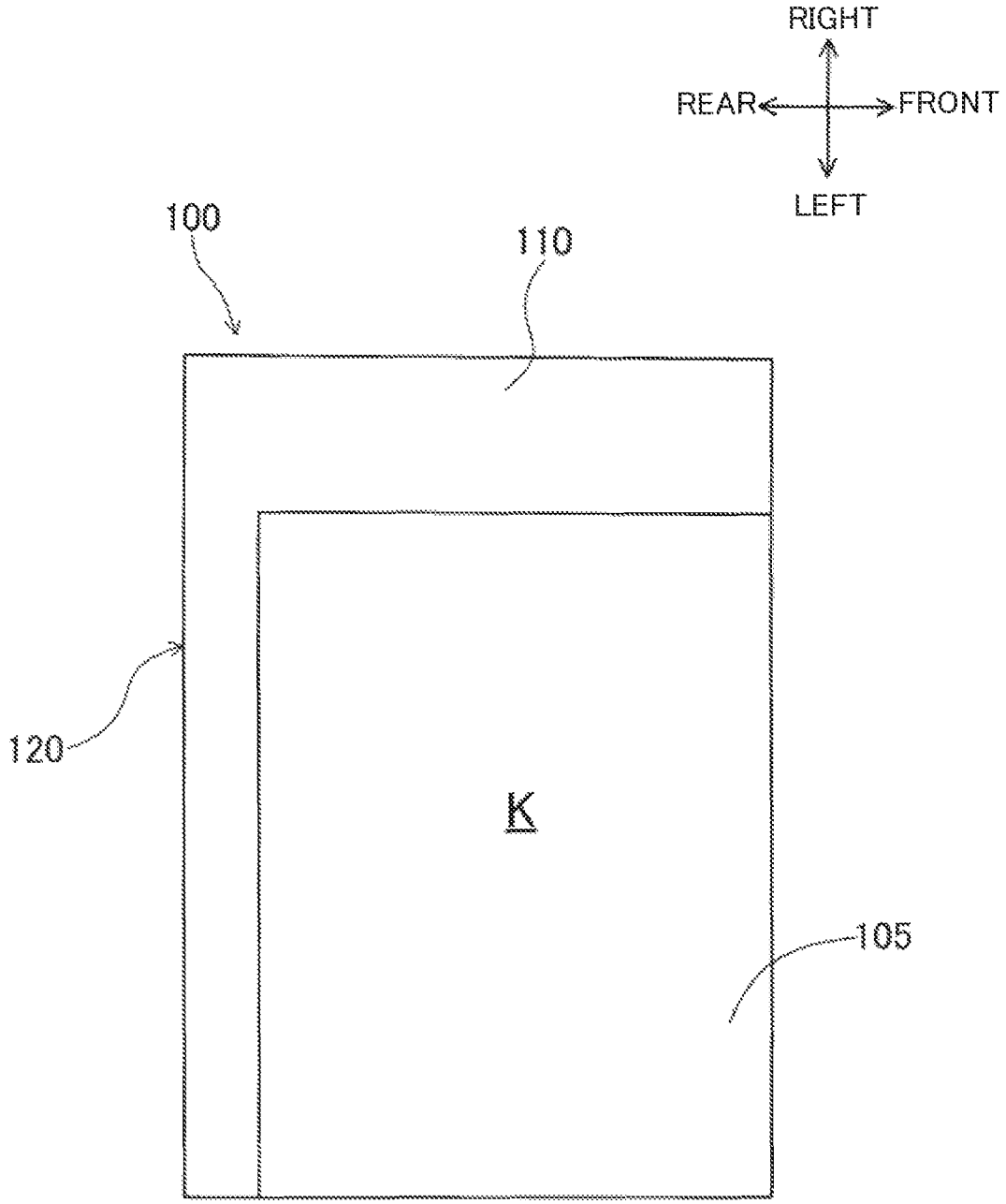
FIG. 3 is a schematic plan view of the main frame, seen from above.
Figure 4:
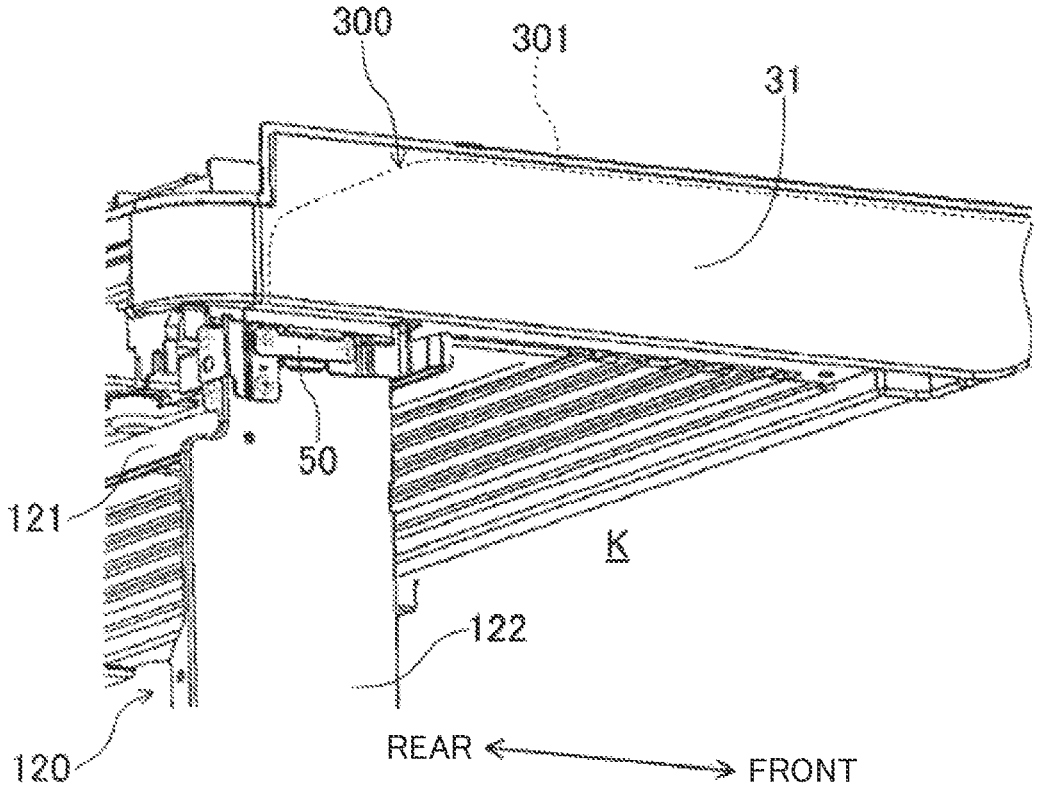
FIG. 4 is an enlarged perspective view of a portion indicated by IV in FIG. 2.

Referring to FIG. 2 to FIG. 4, a frame structure of the image forming apparatus 1 will be described hereunder.

The image forming apparatus 1 includes a main frame 100 and a scanner frame 300 (shown in FIG. 4 only). The main frame 100 and the scanner frame 300 are both formed of a metal material (e.g., iron).

The main frame 100 is a structure constituting the skeleton of the apparatus main body 2. To be more detailed, the main frame 100 includes, as shown in FIG. 2 and FIG. 3, a housing frame 105, and a right support frame 110 and a rear support frame 120 erected on the upper end face of the housing frame 105.

The housing frame 105 is formed by closing, with a flat plate, each side face of the skeleton member assembled in a rectangular parallelepiped shape. Inside the housing frame 105, the essential functional units such as the image forming device 4, the exposure device 5, and the fixing device 8 are accommodated.

The right support frame 110 and the rear support frame 120 are located so as to generally form an L-shape, in a plan view. The right support frame 110 and the rear support frame 120 serve to support the scanner frame 300, from below.

More specifically, the right support frame 110 projects upward, from the right end portion of the upper end face of the housing frame 105. The right support frame 110 has a rectangular shape, elongate in the front-back direction (exemplifying the second direction in the disclosure) in a plan view. The right support frame 110 is located adjacent to the sheet delivery space K, on the upstream (right) side in the sheet delivery direction. Inside the right support frame 110, the sheet delivery mechanism including the discharge roller pair 15 is accommodated. The right support frame 110 corresponds to the first support frame in the disclosure, and the rear support frame 120 corresponds to the second support frame in the disclosure.

The rear support frame 120 projects upward, from the rear end portion of the upper end face of the housing frame 105. The rear support frame 120 extends all the way along the rear edge of the housing frame 105, in the left-right direction.

The scanner frame 300 (see FIG. 4) is formed in a bottomed box shape, with an opening oriented upward. The scanner frame 300 includes four side plates, arranged in a rectangular when viewed from above, and a bottom plate that closes the lower side of the four side plates. The side plates of the scanner frame 300 are each covered with a decorative cover made of a resin, thus to be hidden from outside. The upper face of the scanner frame 300 is closed by an upper cover 31*b* made of a resin, on which a contact glass 31*a* is attached. Inside the scanner frame 300, a reading unit that reads a source document placed on the contact glass 31*a*, and a rail member for guiding the reading unit in a sub scanning direction (left-right direction), are accommodated. The rail member is mounted on the upper face of the bottom plate of the scanner frame 300. On the bottom plate of the scanner frame 300, a belt mechanism for driving the reading unit, and a motor serving as the driving source are mounted, in addition to the rail member.

The scanner frame 300 is supported in a cantilever form, by the right support frame 110 and the rear support frame 120 of the main frame 100. The sheet delivery space K is open toward two directions where the support frames 110 and 120 are not provided (in this embodiment, front side and left side).

With such a cantilever support structure, the left front corner portion of the scanner frame 300, not supported by the support frames 110 and 120, may sag downward owing to the self-weight. The sagging of the corner portion leads to distortion of the scanner frame 300 as a whole. In such a case, the rail member mounted on the bottom plate of the scanner frame 300 may be bent, and the reading unit may be impeded from moving linearly, which may lead to degradation in reading accuracy, when the reading unit reads a source document.

To cope with the mentioned drawback, this embodiment represents an improved connection structure of the rear support frame 120 of the main frame 100 and a left side plate 301 (see FIG. 4) of the scanner frame 300, which prevents the corner portion of the scanner frame 300 from sagging downward.

More specifically, a connecting member 50, to be subsequently described, is employed to connect the rear support frame 120 of the main frame 100 and the left side plate 301 of the scanner frame 300, as shown in FIG. 4.

The rear support frame 120 includes a horizontal support member 121 and a vertical support member 122. The horizontal support member 121 horizontally extends in the left-right direction along the upper end portion of the rear support frame 120, to support the scanner frame 300 from below. The vertical support member 122 extends upward from the left rear corner portion of the housing frame 105, and is connected to the left end portion of the horizontal support member 121.

As shown in FIG. 4, the vertical support member 122 is fixed to the left end face of the horizontal support member 121. The left side plate 301 of the scanner frame 300 is fixed to the left end face of the horizontal support member 121, together with the vertical support member 122.

Hereunder, the configuration of the horizontal support member 121, the vertical support member 122, and the left side plate 301 of the scanner frame 300, in particular the connection structure of these three components will be described in detail. Thereafter, the configuration of the connecting member 50, and the detail of the connection structure that employs the connecting member 50, will be described.

[Detail of Horizontal Support Member 121]

Figure 5:
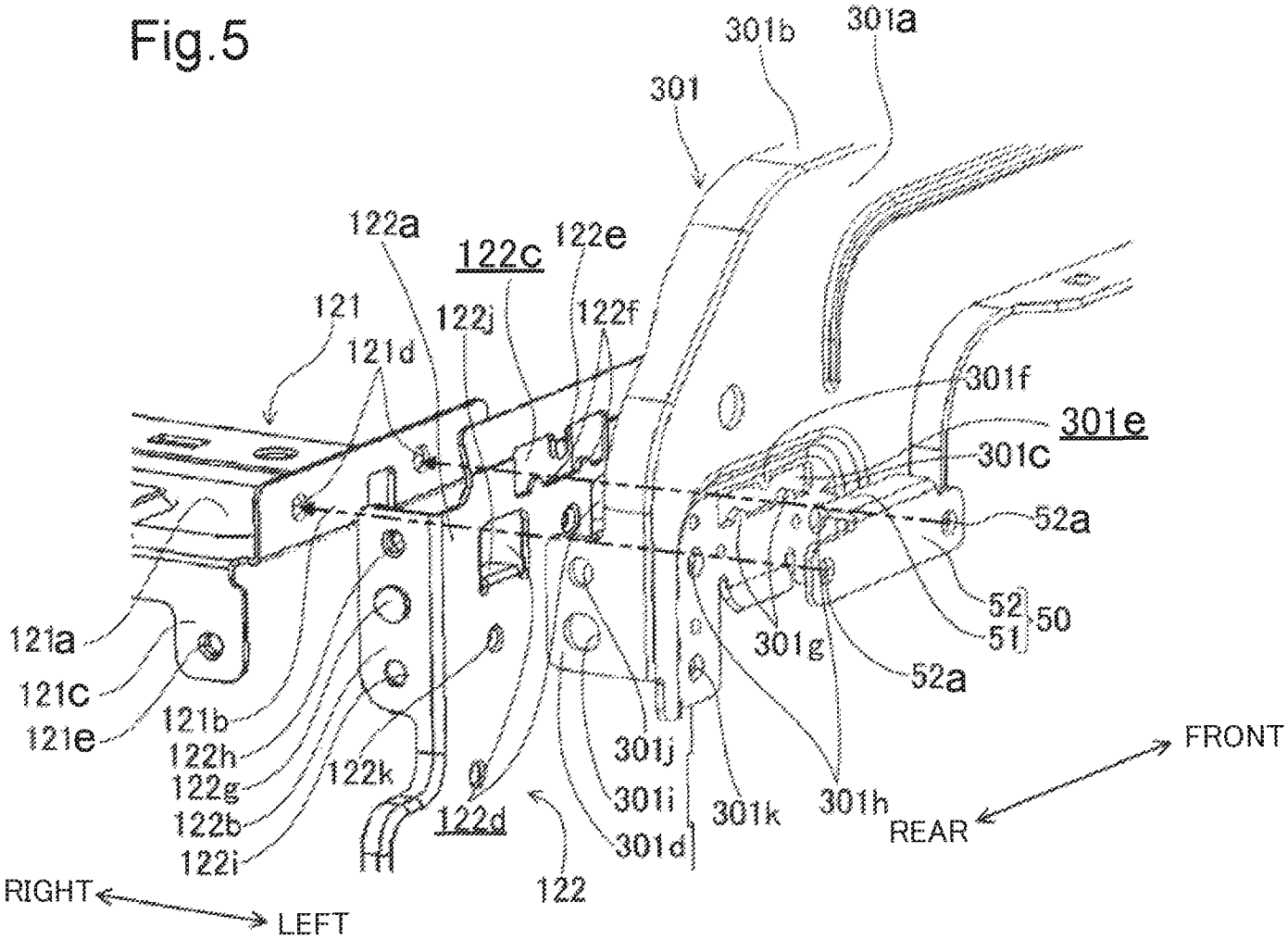
FIG. 5 is an exploded perspective view showing a horizontal support member and a vertical support member constituting a rear support frame, a left side plate (member to be connected) of a scanner frame, and a connecting member.

As shown in FIG. 5, the horizontal support member 121 includes a horizontal plate 121*a* of a rectangular shape, extending in the left-right direction, a first fixing bracket 121*b* projecting upward from the left edge of the horizontal plate 121*a*, and a second fixing bracket 121*c* projecting downward from the left end portion of the rear edge of the horizontal plate 121*a*. The first fixing bracket 121*b* includes a pair of screw holes 121*d*, penetrating therethrough in the left-right direction. The second fixing bracket 121*c* includes a screw hole 121*e*, penetrating therethrough in the front-back direction.

[Detail of Vertical Support Member 122]

The vertical support member 122 includes a vertical plate 122*a* of a rectangular shape, extending in the up-down direction, with the thickness direction oriented in the left-right direction, and a fixing bracket 122*b* projecting to the right side from the rear edge of the upper end portion of the vertical plate 122*a*. A fitting protrusion 122*g* of a circular column shape is formed at a central position of the rear face of the fixing bracket 122*b*, in the up-down direction. A screw hole 122*h* is formed on the upper side of the fitting protrusion 122*g*, so as to penetrate through the fixing bracket 122*b* in the front-back direction, and a screw insertion hole 122*i* is formed on the lower side of the fitting protrusion 122*g*, so as to penetrate through the fixing bracket 122*b* in the front-back direction.

The vertical plate 122*a* includes a through hole 122*c* (exemplifying the opening in the disclosure) formed at the upper end portion, so as to penetrate in the left-right direction. The through hole 122*c* is formed in a rectangular shape, elongate in the front-back direction. At a generally central position of the upper edge of the through hole 122*c*, an upper protrusion 122*e* is formed so as to protrude downward, the upper protrusion 122*e* having a semicircular distal end portion when viewed in the plate thickness direction. In addition, a pair of lower protrusions 122*f* are formed on the lower end face of the through hole 122*c*, with a spacing therebetween in the front-back direction. In the upper end portion of the vertical plate 122*a*, a pair of screw insertion openings 122*d* are formed, side by side in the front-back direction (plate width direction), at positions on the lower side of the through hole 122*c*. The screw insertion openings 122*d* are each formed by cutting out a portion of the vertical plate 122*a* and bending the cut-out portion. Accordingly, a bent piece 122*j* of a rectangular shape, projecting to the right side, is connected to the lower edge of each of the screw insertion openings 122*d*.

[Detail of Left Side Plate 301 (Member to be Connected) of Scanner Frame 300]

The left side plate 301 includes a side plate main portion 301*a* of a rectangular shape, located such that the thickness direction is oriented in the left-right direction. The side plate main portion 301*a* extends in the front-back direction, and the rear end portion thereof is slightly bent downward, so as to be connected to the horizontal support member 121.

All the way along the edge of the side plate main portion 301*a*, ranging from the upper end portion to the rear end portion, a rib 301*b* is formed so as to protrude to the right side. A fixing bracket 301*d* is formed at the rear end portion of the rib 301*b*. The fixing bracket 301*d* is located such that the thickness direction is oriented in the front-back direction. The fixing bracket 301*d* includes a fitting hole 301*i*, formed so as to be engaged with the fitting protrusion 122*g* formed on the vertical support member 122. The fixing bracket 301*d* also includes a screw insertion hole 301*j* penetrating therethrough in the front-back direction, formed on the upper side of the fitting hole 301*i*.

The side plate main portion 301*a* includes a mounting seat 301*c* for receiving the connecting member 50, formed in the rear end portion of the left face. The mounting seat 301*c* is recessed from the surface of the remaining region of the side plate main portion 301*a*. The mounting seat 301*c* in the side plate main portion 301*a* includes a through hole 301*e* (exemplifying the opening in the disclosure), penetrating therethrough in the left-right direction.

The through hole 301*e* has a rectangular shape, elongate in the front-back direction. The through hole 301*e* is formed in the same shape as the through hole 122*c* formed in the vertical support member 122. The through hole 301*e* serves as the insertion opening, through which an insertion plate 51 of the connecting member 50, to be subsequently described, is to be inserted. The expression "inserted through" herein refers to a state where the insertion plate 51 is made to penetrate through the through hole 301*e*. At a central position of the upper end face of the through hole 301*e*, an upper protrusion 301*f* (exemplifying the first protrusion in the disclosure) is formed so as to protrude downward. The upper protrusion 301*f* has a semicircular distal end portion, when viewed in the plate thickness direction (left-right direction). In addition, a pair of lower protrusions 301*g* are formed on the lower end face of the through hole 301*e*, with a spacing therebetween in the front-back direction. The pair of lower protrusions 301*g* are symmetrically located in the front-back direction, with respect to a vertical line passing the center of the upper protrusion 301*f*.

[Configuration of Connecting Member 50]

Figure 6:
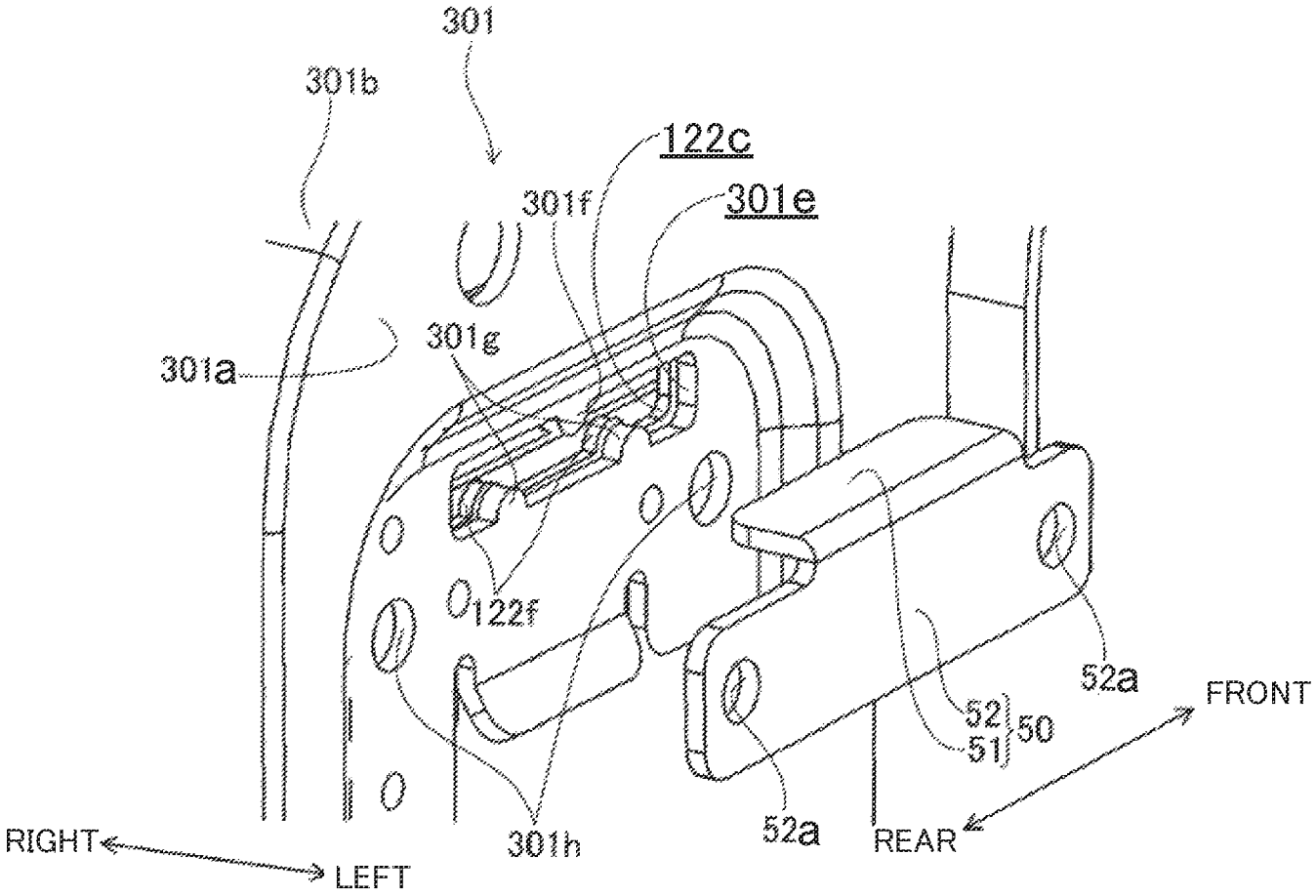
FIG. 6 is a perspective view showing the horizontal support member and the vertical support member constituting the rear support frame, and the left side plate of the scanner frame tentatively assembled, with the connecting member about to be attached.
Figure 7:
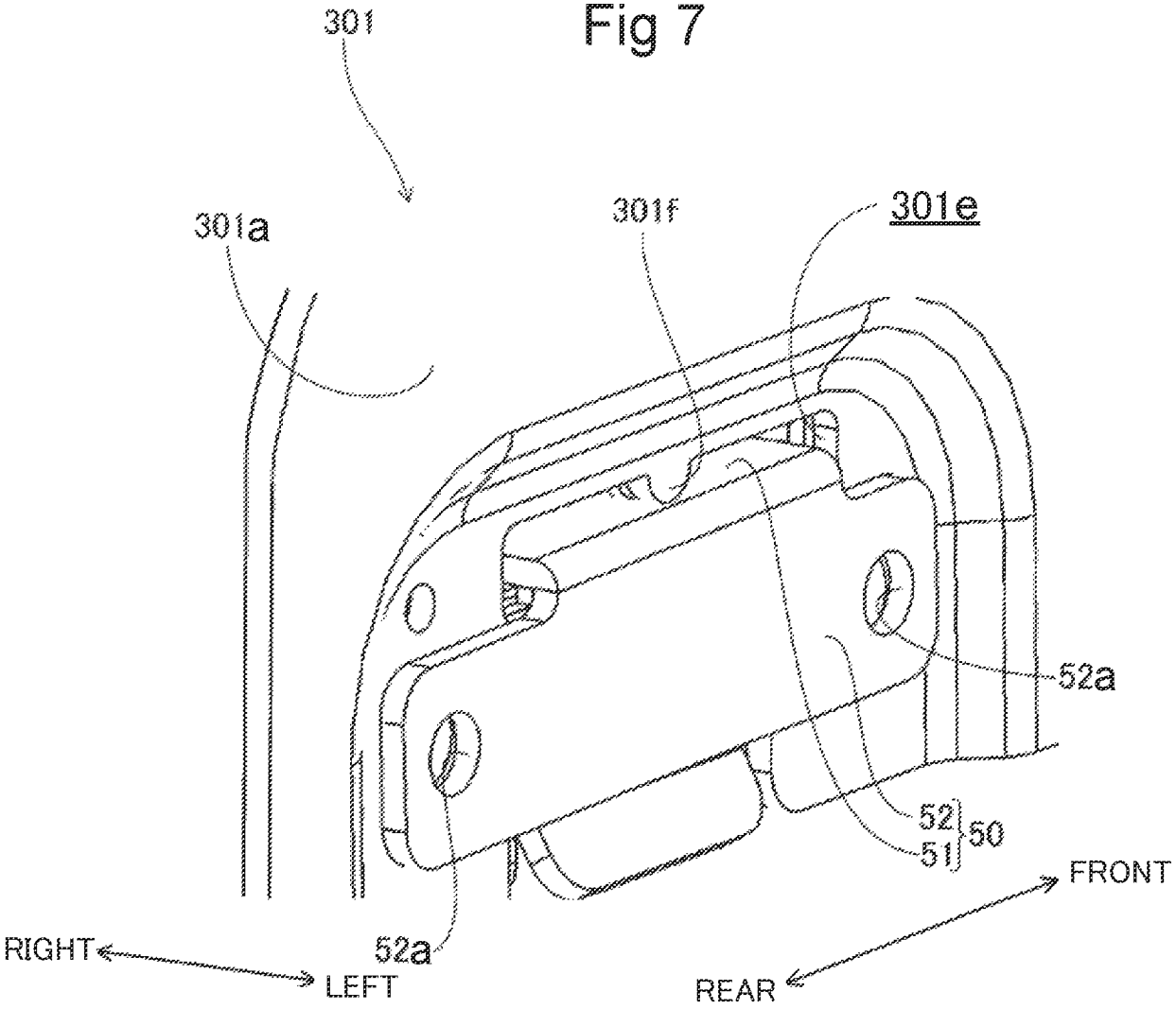
FIG. 7 is a perspective view showing the horizontal support member and the vertical support member constituting the rear support frame, and the left side plate of the scanner frame tentatively assembled, with the connecting member attached.
Figure 8:
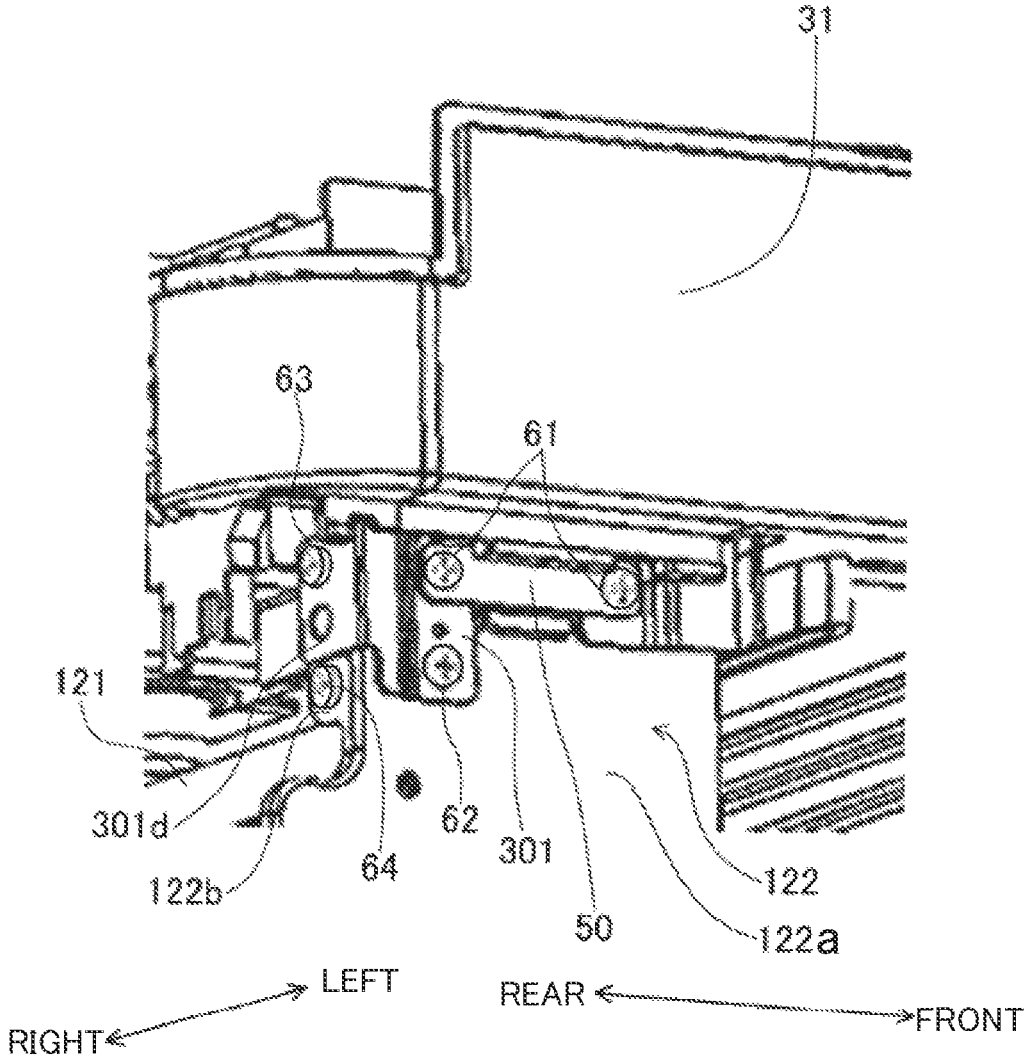
FIG. 8 is an enlarged perspective view of a portion of FIG. 4, showing the horizontal support member and the vertical support member constituting the rear support frame, and the left side plate of the scanner frame, connected by means of the connecting member.

As shown in FIG. 5 to FIG. 7, the connecting member 50 is formed by bending a sheet metal material into a shape having an L-shaped cross-section. In the following description, the front and rear sides, and the left and right sides will be defined on the assumption that the connecting member 50 has been attached as shown in FIG. 7, unless otherwise specifically noted.

The connecting member 50 includes the insertion plate 51 of a rectangular shape horizontally extending in the front-back direction, and a mounting plate 52 of a rectangular shape, suspended downward from the left edge of the insertion plate 51. The insertion plate 51 is made to penetrate through the through hole 301*e* in the left side plate 301 of the scanner frame 300, and also inserted through the through hole 122*c* in the vertical support member 122 of the main frame 100. The mounting plate 52 has a rectangular shape elongate in the front-back direction. A screw insertion hole 52*a* is formed at each of the end portions of the mounting plate 52 in the front-back direction.

[Connection Procedure]

Referring now to FIG. 5 to FIG. 8, the connection procedure of the horizontal support member 121, the vertical support member 122, and the left side plate 301 will be described hereunder.

First, the vertical support member 122 is fixed to the left end portion of the horizontal support member 121. To be more detailed, the vertical plate 122*a* of the vertical support member 122 is brought into contact with the left end face of the first fixing bracket 121*b* of the horizontal support member 121. Then the horizontal support member 121 is placed on the upper face of the pair of bent pieces 122*j* formed in the vertical support member 122, so as to be supported thereby. In this state, a screw 64 (see FIG. 8) is inserted through the screw insertion hole 122*i* in the vertical support member 122, and engaged with the screw hole 121*e* in the horizontal support member 121. Thus, the vertical support member 122 is fixed to the horizontal support member 121.

Then the vertical support member 122 and the left side plate 301 of the scanner frame 300 are connected together, via the connecting member 50.

First, the fitting hole 301*i* in the left side plate 301 is fitted on the fitting protrusion 122*g* (see FIG. 5) of the vertical support member 122, to set the left side plate 301 in position, in the height direction. Then the vertical support member 122 is positioned, such that the through hole 301*e* in the left side plate 301 is aligned with the through hole 122*c* in the vertical support member 122. FIG. 6 illustrates the state where the vertical support member 122 has been set in position, with the through holes 122*c* and 301*e* aligned with each other. Then the insertion plate 51 of the connecting member 50 is inserted through the through holes 122*c* and 301*e*. The insertion depth of the insertion plate 51 is delimited by the mounting plate 52 of the connecting member 50, being made to abut against the mounting seat 301*c*, as shown in FIG. 7. The connecting member 50 is fixed by screws 61 (see FIG. 8) respectively inserted through the pair of screw insertion holes 52*a* in the mounting plate 52. The screws 61 are, as indicated by dash-dot-dot arrows in FIG. 5, each passed through the screw insertion hole 52*a* of the connecting member 50, the screw insertion hole 301*h* in the left side plate 301, and the screw insertion opening 122*d* in the vertical support member 122, and engaged with the screw hole 121*d* formed in the horizontal support member 121. Thus, the left side plate 301 of the scanner frame 300 is fixed to the horizontal support member 121, with the vertical support member 122 interposed therebetween. The left side plate 301 is also fixed by two screws 62 and 63 (see FIG. 8), in addition to the two screws 61. The screw 62 is passed through a screw insertion hole 301*k* formed in the mounting seat 301*c* of the left side plate 301, and engaged with a screw hole 122*k* of the vertical support member 122. The screw 63 is passed through the screw insertion hole 301*j* formed in the fixing bracket 301*d*, and engaged with the screw hole 122*h* of the vertical support member 122.

Figure 9:
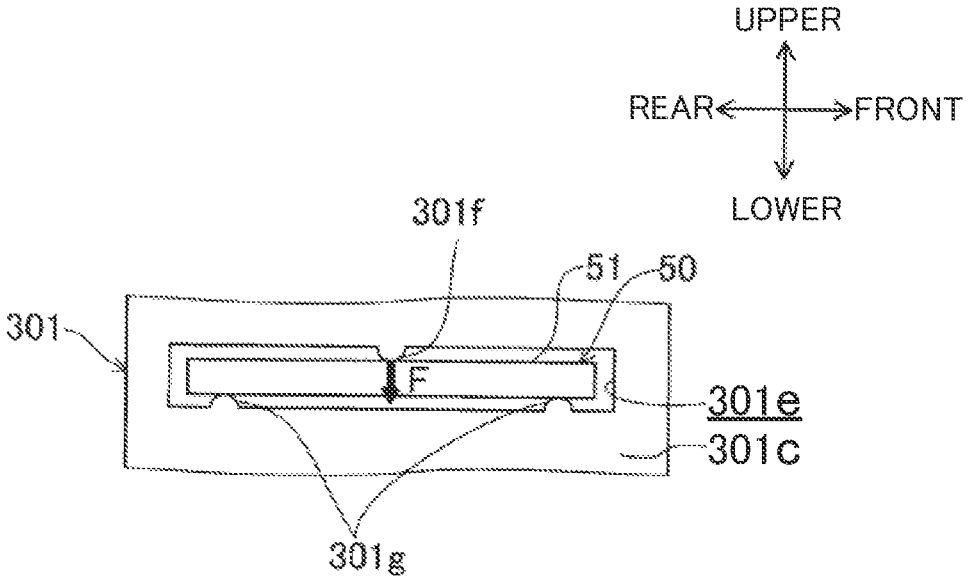
FIG. 9 is a schematic diagram for explaining a load transmission path, from the left side plate of the scanner frame to the connecting member.
Figure 10:
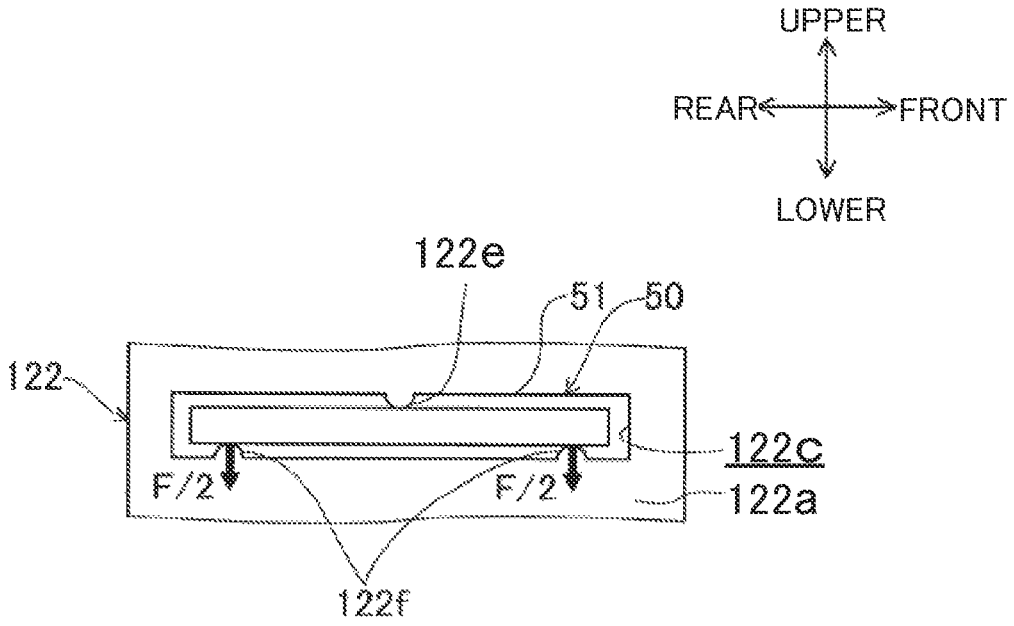
FIG. 10 is a schematic diagram for explaining a load transmission path, from the connecting member to the vertical support member.

FIG. 9 and FIG. 10 are schematic drawings for explaining a transmission path of static load F, imposed on the connecting member 50 from the image reading device 3.

As shown in FIG. 9, the static load F from the image reading device 3 is transmitted to the insertion plate 51 of the connecting member 50, through the upper protrusion 301*f* in the through hole 301*e*, formed in the left side plate 301 of the scanner frame 300. The load F transmitted to the insertion plate 51 is transmitted therefrom to the vertical support member 122 located on the right side of the (far side in the direction vertical to the sheet of FIG. 9). In other words, the load F imposed on the insertion plate 51 is transmitted to the vertical support member 122, through the pair of lower protrusions 122*f* in the through hole 122*c* formed in the vertical support member 122, as shown in FIG. 10.

In the case where the side plate frame is provided, as in the existing image forming apparatus, the downstream side of the sheet delivery space in the sheet delivery direction (opposite to the first support frame) is closed by the side plate frame. Therefore, the side plate frame obstructs the user from picking up the sheet from the sheet delivery space.

Instead of providing the side plate frame, therefore, it may be possible to employ the existing fastening member (connecting member), to improve the connection rigidity between the second support frame and the scanner frame.

However, the fastening member only fixes the end portions of the rectangular plate material, which is insufficient to effectively prevent the scanner frame from sagging downward.

In contrast, in the image forming apparatus 1 according to this embodiment, the vertical support member 122 and the left side plate 301 of the scanner frame 300 respectively include the through holes 122*c* and 301*e*, through which the connecting member 50 is inserted, in the left-right direction.

The connecting member 50 includes the insertion plate 51, to be passed through the through hole 301*e* in the left side plate 301 of the scanner frame 300 and also inserted through the through hole 122*c* in the vertical support member 122, and is attached such that the upper face of the insertion plate 51 contacts the upper end face of the through hole 301*e* in the left side plate 301 via one position (see FIG. 9), and the lower end face of the through hole 122*c* in the vertical support member 122, via two positions (see FIG. 10) spaced from each other in the front-back direction.

Because of the mentioned configuration, the rear end portion of the left side plate 301 of the scanner frame 300 is supported by the vertical support member 122 via the connecting member 50, at two positions spaced from each other in the front-back direction. Accordingly, the front end portion of the left side plate 301 can be prevented from sagging downward, for example compared with the case where the rear end portion of the left side plate 301 is supported by the vertical support member 122 via one position. To be more detailed, when the rear end portion of the left side plate 301 is supported via one position only, the left side plate 301 can rotate about the supporting position serving as the fulcrum, and resultantly the front end portion of the left side plate 301 may be largely displaced downward. According to this embodiment, in contrast, since the rear end portion of the left side plate 301 is supported via two positions spaced from each other in the front-back direction, these two positions serve to restrict the left side plate 301 from rotating. Therefore, the left front corner portion of the scanner frame 300 can be prevented from sagging downward, despite not being supported by the support frames 110 and 120 of the main frame 100. Such a configuration further prevents the degradation in reading accuracy of the source image, arising from the deformation of the scanner frame 300.

On the upper end face of the through hole 301*e* in the left side plate 301 of the scanner frame 300, the upper protrusion 301*f* is formed so as to protrude downward and contact the insertion plate 51 of the connecting member 50. On the lower end face of the through hole 122*c* in the vertical support member 122, at least two lower protrusions 122*f* formed so as to protrude upward with a spacing therebetween, and contact the insertion plate 51 of the connecting member 50.

The mentioned configuration eliminates the need to form protrusions on the surface of the insertion plate 51, thereby reducing the cost of the connecting member 50.

The upper protrusion 301*f* of the scanner frame 300, and the two lower protrusions 122*f* of the vertical support member 122 are formed so as to make linear contact with the insertion plate 51 of the connecting member 50, along the left-right direction. In other words, the upper protrusion 301*f* and the lower protrusions 122*f* are formed in a circular cylindrical shape, when viewed in the left-right direction.

The mentioned configuration mitigates the accuracy requirement with respect to the shape of the upper protrusion 301*f* of the scanner frame 300 and the two lower protrusions 122*f* of the vertical support member 122, compared with the case where the protrusions 301*f* and 122*f* are brought into planar contact with the insertion plate 51 of the connecting member 50. Therefore, the costs of the scanner frame 300, the vertical support member 122, and the connecting member 50 can be reduced.

According to this embodiment, the connecting member 50 includes the mounting plate 52, connected to the proximal end of the insertion plate 51, opposite to the distal end, extending in the vertical direction, and having the plurality of screw insertion holes 52*a*, and is fixed by the screws 61, respectively inserted through the pair of screw insertion holes 52*a*, passed through the left side plate 301 of the scanner frame 300 and the vertical support member 122 of the rear support frame 120, and engaged with the screw hole 121*d* formed in the horizontal support member 121 of the rear support frame 120.

The mentioned configuration enables the left side plate 301 of the scanner frame 300 and the vertical support member 122 of the rear support frame 120 to be fixed together to the horizontal support member 121, via the connecting member 50 and the screws 61.

OTHER EMBODIMENTS

According to the foregoing embodiment, the upper face of the insertion plate 51 of the connecting member 50 is brought into contact with the upper end face of the through hole 301*e* in the left side plate 301, via one position (see FIG. 9). However, without limitation to the above, the insertion plate 51 may contact the upper end face of the through hole 301*e* via two or more positions.

According to the foregoing embodiment, the lower face of the insertion plate 51 of the connecting member 50 is brought into contact with the lower end face of the through hole 122*c* in the vertical support member 122, via two positions spaced from each other in the front-back direction (see FIG. 10). However, without limitation to the above, the insertion plate 51 may contact the lower end face of the through hole 122*c* via three or more positions.

Although the upper protrusion 301*f* and the pair of lower protrusions 122*f* are formed in the circular cylindrical shape in the foregoing embodiment, the disclosure is not limited thereto. The upper protrusion 301*f* and the pair of lower protrusions 122*f* may be formed, for example, in a square or triangular column shape.

Although the image forming apparatus 1 is exemplified by the copier in the foregoing embodiment, the disclosure is not limited thereto. The image forming apparatus 1 may be, for example, a multifunction peripheral (MFP).

INDUSTRIAL APPLICABILITY

As described thus far, the disclosure is advantageously applicable to an image forming apparatus, and in particular to a copier or a multifunction peripheral (MFP) of an in-body delivery type.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

a housing frame accommodating an image forming device that forms an image on a sheet;

a scanner frame located on an upper side of the housing frame, so as to provide a sheet delivery space between the housing frame and the scanner frame;

a first support frame accommodating a sheet delivery mechanism that discharges the sheet in a predetermined first direction, and supporting the scanner frame, at a position adjacent to the sheet delivery space on one end portion in the first direction;

a second support frame supporting the scanner frame, at a position adjacent to the sheet delivery space on one end portion in a second direction orthogonal to the first direction; and a connecting member connecting and fixing the second support frame and the scanner frame together, wherein the second support frame includes:

a horizontal support member extending along the first direction, and supporting the scanner frame via an upper face; and a vertical support member extending in an up-down direction, and having an upper end portion fixed to an end face of the horizontal support member on a side of the other end portion in the first direction, the scanner frame includes a member to be connected located on the side of the other end portion in the first direction, and connected to the vertical support member from the side of the other end portion in the first direction, the vertical support member and the member to be connected each include an opening, the connecting member includes an insertion plate penetrating through the opening of the member to be connected in the first direction, and inserted through the opening of the vertical support member, and the insertion plate has an upper face located in contact with an upper end face of the opening of the member to be connected, at least via one position, and has a lower face located in contact with a lower end face of the opening of the vertical support member, at least via two positions spaced from each other in the second direction.

2. The image forming apparatus according to claim 1, wherein the member to be connected includes at least one first protrusion, formed on the upper end face of the opening, so as to protrude downward and contact the insertion plate, and the vertical support member includes at least two second protrusions, formed on the lower end face of the opening with a spacing between each other in the second direction, so as to protrude upward and contact the insertion plate.

3. The image forming apparatus according to claim 2, wherein the first protrusion and the at least two second protrusions are in linear contact with the insertion plate, along the first direction.

4. The image forming apparatus according to claim 3, wherein a protruding face of the first protrusion and respective protruding faces of the at least two second protrusions are formed in a circular cylindrical shape.

5. The image forming apparatus according to claim 1, wherein the connecting member further includes a mounting plate, connected to a proximal end of the insertion plate, opposite to a distal end to be inserted, extending in a vertical direction, and having a plurality of screw insertion holes, and the scanner frame is fixed to the second support frame, by screws inserted through the respective screw insertion holes of the mounting plate, passed through the member to be connected and the vertical support member, and engaged with a screw hole formed in the horizontal support member.

6. The image forming apparatus according to claim 1, wherein the member to be connected is a rectangular side plate, located such that a thickness direction is oriented in the first direction.

* * * * *